US005257437A

United States Patent [19]

Salice

[11] Patent Number: 5,257,437

[45] Date of Patent: Nov. 2, 1993

[54] MOUNTING PLATE FOR SECURING A HINGE BRACKET

[75] Inventor: Luciano Salice, Via Ronco, Italy

[73] Assignee: Arturo Salice S.p.A., Novedrate, Italy

[21] Appl. No.: 633,532

[22] Filed: Dec. 28, 1990

[30] Foreign Application Priority Data

Dec. 28, 1989 [DE] Fed. Rep. of Germany ..... 3943210

[51] Int. Cl.[5] ..... E05D 7/04

[52] U.S. Cl. ..... 16/239; 16/236; 16/240; 16/DIG. 43; 16/DIG. 34

[58] Field of Search ..... 16/235, 236, 239, 243, 16/383, 237, DIG. 43, 249, DIG. 34, 238, 257, 258, 240

[56] References Cited

U.S. PATENT DOCUMENTS

| | | | |
|---|---|---|---|
| 3,646,635 | 3/1972 | Stermac | 16/239 |
| 4,313,239 | 2/1982 | Tsuncki | 16/236 |
| 4,653,144 | 3/1987 | Lautenschlager | 16/249 |
| 4,785,497 | 11/1988 | Salice | 16/DIG. 43 |
| 4,976,006 | 12/1990 | Lautenschläger | 16/DIG. 43 |

FOREIGN PATENT DOCUMENTS

| | | | |
|---|---|---|---|
| 334777 | 5/1976 | Austria . | |
| 360851 | 6/1980 | Austria . | |
| 234544 | 9/1987 | European Pat. Off. . | |
| 2549352 | 5/1977 | Fed. Rep. of Germany | 16/239 |
| 2655749 | 6/1978 | Fed. Rep. of Germany | 16/149 |
| 2723850 | 11/1978 | Fed. Rep. of Germany | 16/236 |
| 3004313 | 8/1981 | Fed. Rep. of Germany . | |
| 3426672 | 1/1986 | Fed. Rep. of Germany . | |

*Primary Examiner*—Lowell A. Larson
*Assistant Examiner*—Donald M. Gurley
*Attorney, Agent, or Firm*—Keck, Mahin & Cate

[57] ABSTRACT

A mounting plate for securing a hinge bracket, and preferably a hinge bracket of a furniture hinge to a corpus part of a furniture piece or the like, has bores for receiving fixing screws and adjustable secures the hinge bracket to the plate. In order to provide a mounting plate which has a simple design, can be actuated in a simple manner, and permits a hinge bracket to be adjusted in height, the mounting plate, in its rear portion, is mounted so as to be pivotally movable relative to the corpus part about a pivotal axis, which may be imaginary or defined by a pivot, is guided for a limited pivotal movement about the axis, and is then held or clamped in adjustable angular position.

12 Claims, 6 Drawing Sheets

MOUNTING PLATE FOR SECURING A HINGE BRACKET

BACKGROUND OF THE INVENTION

1. Field of the invention

This invention relates to a mounting plate for securing a hinge bracket, and, more specifically, a hinge bracket of a furniture hinge, to a corpus part of a piece of furniture. The mounting plate has bores for receiving fixing screws, and is provided with means for adjustably securing the hinge bracket to the plate.

2. Description of the Prior Art

A mounting plate which is of a kind having a hinge bracket, which can selectively be joined to a piece of furniture by fixing screws, or resiliently locked to the furniture piece by a snap-action joint, is known, e.g., from German Patent Specification 3,426,672.

Owing to necessary manufacturing tolerances and inaccuracies in assembling operations, hinge brackets must be adjustable in the depth and height directions of the furniture and in a lateral direction. For this reason, it is desired to provide hinges which, after having been mounted, can be adjusted in a simple manner in three directions i.e., depth, height and lateral directions, so that furniture doors or flaps can properly be adjusted.

One known mounting plate, disclosed in German Patent Specification 3,426,672, permits a sliding displacement of a hinge bracket on a mounting plate in the longitudinal direction for adjustment in the depth direction, and permits the hinge bracket to be pivotally moved about a transverse axis for adjustment of the gap between the corpus part and the door or flap.

SUMMARY OF THE INVENTION

Numerous other designs are known which permit an adjustment in height by allowing a hinge bracket to laterally be displaced relative to a mounting plate or parts of the mounting plate. However, such designs are rather expensive. For this reason, it is an object of the present invention to provide a mounting plate which is of the kind described, i.e., adjustable, and which has a simple design and can be actuated in a simple manner to permit a hinge bracket to be adjusted in height.

In a mounting plate of the kind described, such an object is accomplished, in accordance with the present invention, by mounting the mounting plate, in its rear portion, so as to be pivotally movable relative to the corpus part about a pivotal axis, which may be imaginary or defined as a pivot. The mounting plate is guided by guiding means for a limited pivotal movement about the axis, and is held in adjustable angular position by retaining means. The invention is based on the recognition that to adjust the height of a hinge bracket, it is not essential to actually displace the hinge bracket. Rather, a small adjustment in height, which is usually sufficient, can be effected by a pivotal movement of the mounting plate. Such pivotal movement for an adjustment in height can usually be effected by moving the mounting plate only through a small angle. The small inclination resulting from the pivotal movement can be tolerated, because it will not adversely affect the function of the hinge, and is within the range of conventional bearing clearances and of readily possible elastic deformations.

Because, in accordance with the invention, the adjustment in height is effected only by a pivotal movement of the mounting plate which carries the hinge bracket, the mounting plate can be provided with a particularly simple, economical design.

In particular, the mounting plate, in accordance with the invention, can be handled in a simple manner, because for an adjustment in height, it is no longer necessary to loosen a plurality of screws or to effect complicated adjustments. For an adjustment of the angular position of the hinge, it is sufficient to loosen or actuate the holding means while the mounting plate is still held on its pivotal axis, and the desired adjusted position can be simply achieved by pivotal movement of the mounting plate.

In accordance with a particularly simple design, the pivotal axis is defined by a fixing screw, which is adapted to be screwed into the corpus part of the furniture piece. The guiding means are formed by a slot, and the retaining means are formed by a fixing screw which extends through the slot. In this embodiment, the invention provides a conventional mounting plate, which has a bore defining the pivotal axis, and a slot which is concentric with the bore. The slot need not be concentrically curved, but may extend tangentially to a concentrically curved arcuate portion, because the usual backlash of the fixing screw in the slot eliminates the need for a slot having a concentric curvature.

The bore for the fixing screw which defines the pivotal axis may be provided on the longitudinal center line of the mounting plate and the slot may be transversely oriented relative to the longitudinal center line. The slot is desirably provided in a forward portion of the mounting plate.

In a different embodiment, the mounting plate is cross-shaped, and is provided in its rear end portion, or in a wing portion, with a bore for the fixing screw which defines the pivotal axis. The mounting plate is provided, in the other lateral wing portion, with a slot, which, when the fixing screw extending through the slot is loosened, permits a pivotal movement of the mounting plate about the fixing screw which defines the pivotal axis.

In a different embodiment, the mounting plate includes two parallel sheet steel plate elements, which lie one on the other and are integrally connected at a rear portion by a curved bight. The base plate element is provided with fixing bores, and the cover plate element is formed, in its forward portion, with a transverse slot. A fixing screw extends through the slot, and is screwed into a tapped bore formed in the base plate element. In this design, the cover plate element is pivotally movable relative to the base plate element about an imaginary axis, which is defined by the arcuate bight, which is elastically deformable. The mounting plate is suitably made from a zinc die casting alloy, such as Zamak. However, the mounting plate just described may be a blank punched from sheet steel. The lower, or base, plate element, moreover, may be provided with protruding flanges, or wings, which are formed with bores for fixing screws.

In a further embodiment of the invention, the mounting plate includes a base plate element, which is adapted to be fixed by screws to the corpus part, and a cover plate element, which at least partly covers the base plate element and is pivoted on a pivotal axis provided at the rear portion of the base plate element. The forward portion of the base plate element is provided with a guide or a guide portion for guiding the cover plate element. Such a bipartite mounting plate further facilitates the adjustment in a height direction.

The pivotal axis may be defined by a bushing which is joined to the cover plate element or the base plate element so that the bore of the bushing can also receive a fixing screw. The guiding means may be formed from a forward edge portion of the base plate element. The edge portion, in this case, is concentrically curved about the pivot and extends into an approximately mating groove of the cover plate element. The edge portion suitably has a side face, at an acute angle with the top surface of the base plate element, so that the side face extends into a correspondingly undercut groove in an overlapping edge portion of the cover plate element. The adjustment in height will be particularly simplified if an eccentric element is used for pivotal adjustment.

In a different embodiment, the base plate element is provided with a rib, which is trapezoidal in cross-section, and the cover plate is provided with an approximately mating groove. The pivotal axis is defined by a screw, which is adapted to extend through a bore that opens into the groove and to be screwed into a tapped bore of the rib to a substantial extent, so that the guiding forward edge portion of the base plate element can be clamped in the guiding groove of the cover plate element. Inclined surfaces of the rib and of the groove slide on each other like wedges as the fixing screw is screwed into the tapped bore.

DETAILED DESCRIPTION OF THE PREFERRED EMBODIMENTS

Illustrative embodiments of the invention will now be described in more detail with reference to the drawings.

Figure 1:
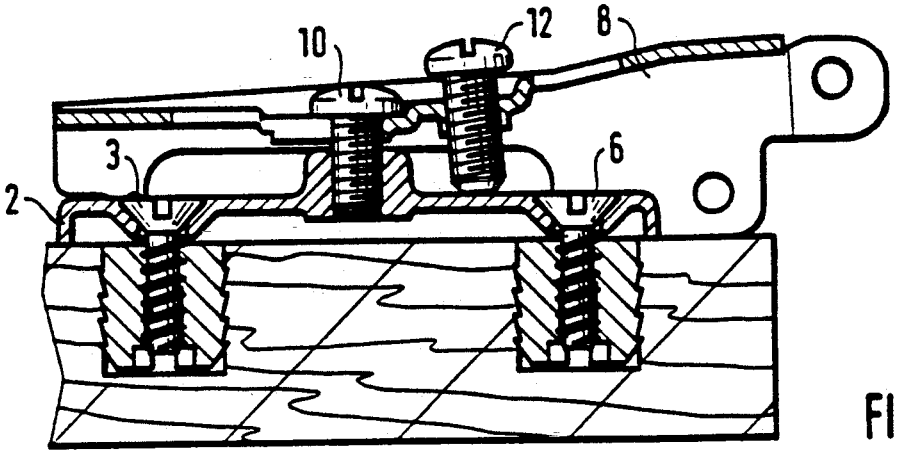
FIG. 1 is a longitudinal, sectional view, showing a mounting plate which has been secured to a corpus part of a furniture piece, and a hinge bracket fixed to the mounting plate.
Figure 2:
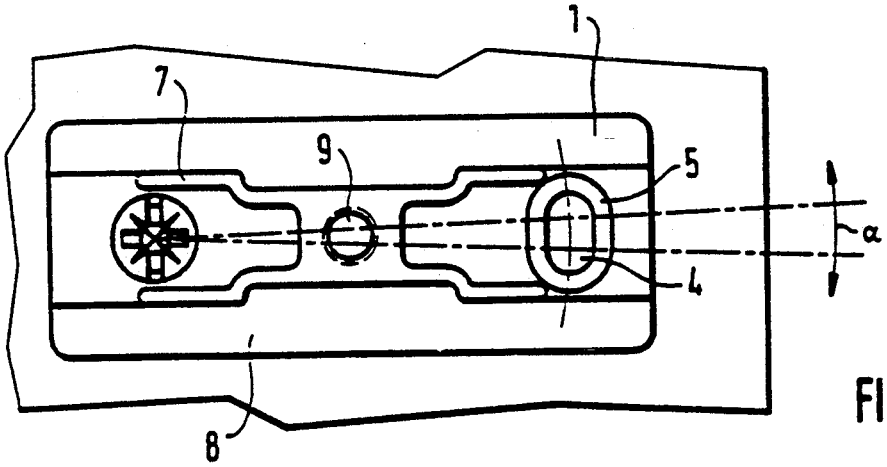
FIG. 2 is a top plan view showing the mounting plate of FIG. 1 without the hinge bracket.

In the first embodiment, shown in FIGS. 1 and 2, the mounting plate is formed from a rectangular plate 1, which is preferably made of a zinc die casting alloy, such as Zamak or the like, and is provided with an angled-down flange 2. The rectangular plate 1 is further provided with a rear bore 3*a* having a turned-in, conical rim 3*r* serving to receive the head 3*h* of a plug screw 3, and a forward slot 4 having a beveled edge 5 and serving to receive a plug screw 6. Plug screws 3 and 6 are received in threaded bores formed in plug inserts (not indicated) which, in turn, are mounted in plug insert receiving bores formed in, for example, a door frame (also not indicated) provided on a piece of furniture. The mounting plate 1 is provided, on its top surface, with an upstanding, H-shaped web 7, which serves to retain the hinge bracket 8. The hinge bracket 8 is U-shaped in cross-section. The intermediate portion 7*i* of the H-shaped web 7 is enlarged in width, i.e., thickness, and is provided with a tapped bore 9 for receiving a first, fixing screw 10, which extends through a keyhole-shaped slot 8*s* of the hinge bracket 8. A second, backing screw 12 is screwed into the hinge bracket 8 and serves to secure the hinge bracket 8 in different angular positions on the mounting plate 1 for an adjustment of a gap.

When the plug screws 3 and 6 are loosened, the mounting plate 1 can be pivotally moved, through an angle $\alpha$, about the rear plug screw 3. Plug screw 3, which extends through the rear bore 3*a*, which forms a round fixing bore, defines the pivotal axis for the mounting plate 1. The angle $\alpha$ of pivotal movement is determined by the length of the forward slot 4. A pivotal movement of the mounting plate 1 through the angle $\alpha$ will result in only a slight inclination of the hinge bracket 8. Such a slight inclination permits adjustment of a door, to which hinge bracket 8 is secured, in height, or lateral adjustment of a flap on a piece of furniture, without having the inclination adversely affect the function of the hinge. When the desired adjustment in height or laterally has been effected by the pivotal movement, the plug screw 6, which extends through the forward slot 4, is tightened. In addition, the plug screw 3 may be tightened, although this is not essential, because the plug screw 3 simply defines a pivotal axis and the mounting plate 1 will be adequately fixed in position when the plug screw 6 has been tightened.

Figure 3:
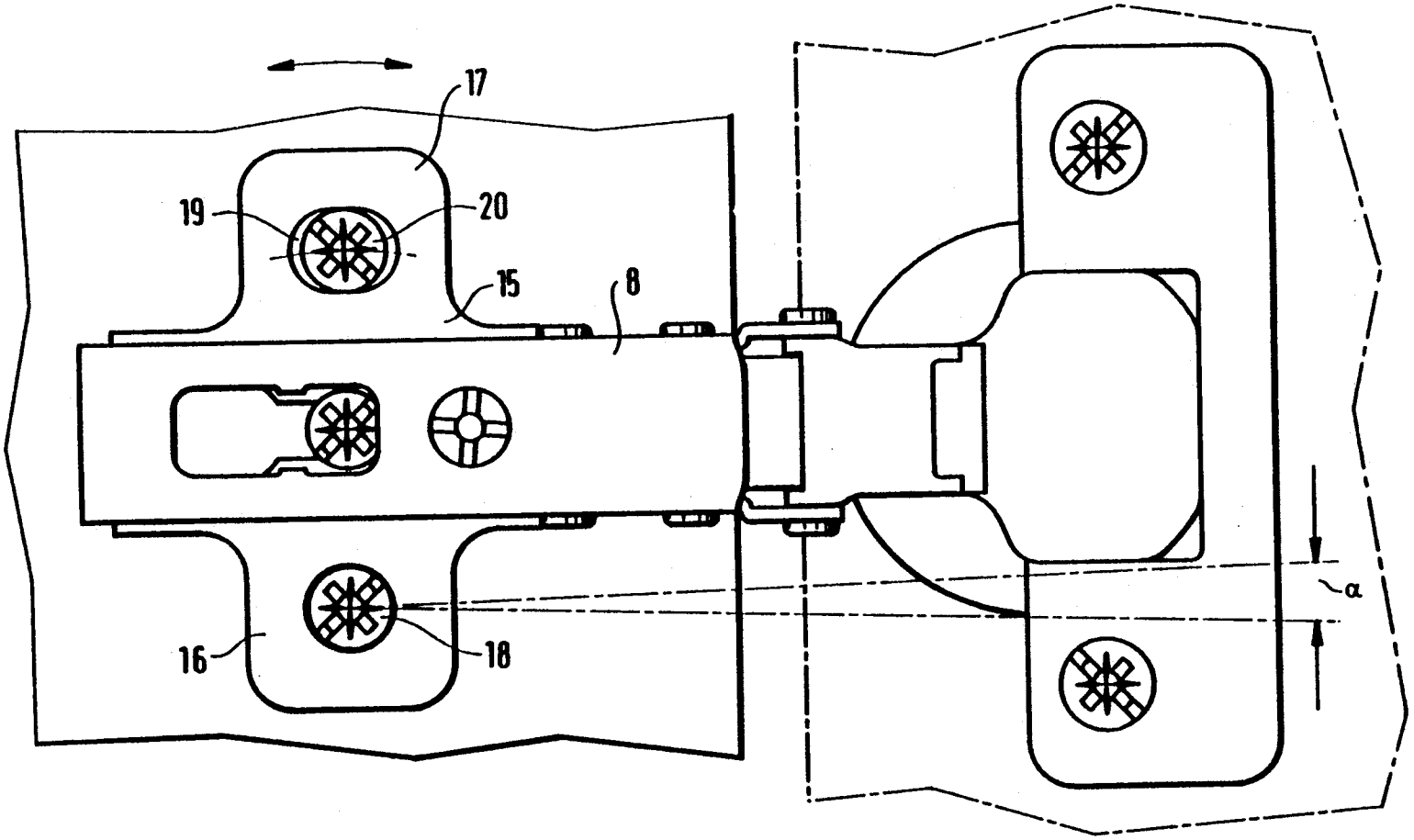
FIG. 3 is a top plan view showing a cross-shaped mounting plate, which has been fixed by screws to a corpus part of a furniture piece, and a hinge bracket which is secured to the mounting plate.
Figure 5:
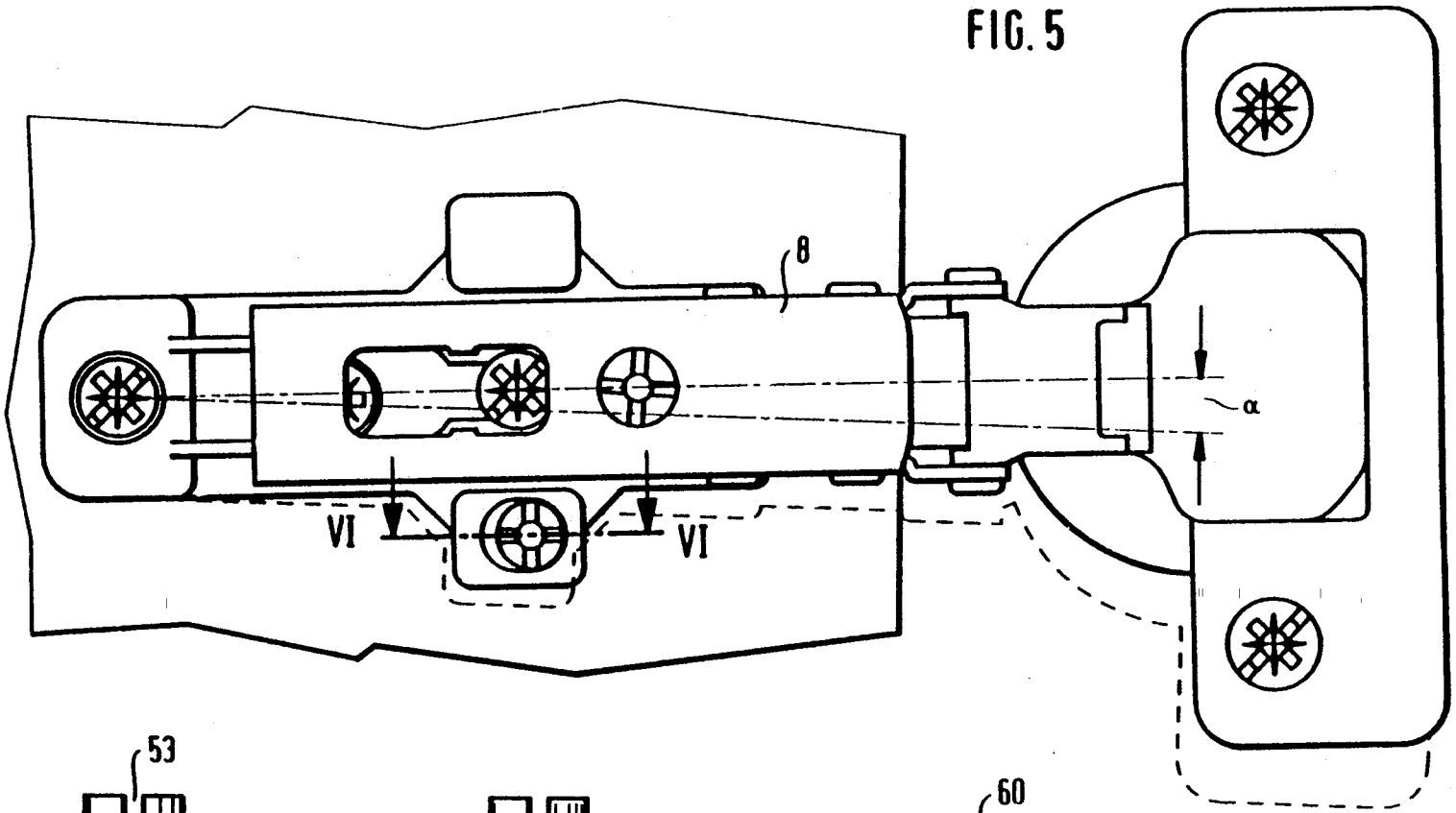
FIG. 5 is a top plan view showing a mounting plate which includes a base plate element and a cover plate element and which has been provided with a hinge bracket.

In the illustrative embodiment shown in FIG. 3, the mounting plate 15 is provided with lateral wing portions 16 and 17, which extend laterally from upstanding webs (not shown) which are similar to the upstanding webs 7 of FIGS. 1 and 2. The wing portion 16 is formed with a round bore, which has a conical rim which conforms to the head of the fixing screw 18. The opposite wing portion 17 is formed with a slot 19, through which the fixing screw 20 extends. The shank of the fixing screw 18 defines a pivotal axis for the mounting plate 15. The length of the slot 19 determines the magnitude of the angle α through which the hinge bracket 8 can be pivotally moved relative to the door frame or other element on which it is mounted. As in the mounting plate described with reference to FIG. 2, the central portion of the mounting plate 15 is provided with an H-shaped web, to which the hinge bracket 8 is secured. FIG. 3 also shows the manner in which the hinge brackets of the present invention are typically used. As FIG. 3 shows, the sides of hinge bracket 8 are provided with extensions 100, which are connected by pin 102 to a door mounted bracket 104, secured to door 106.

Figure 4:
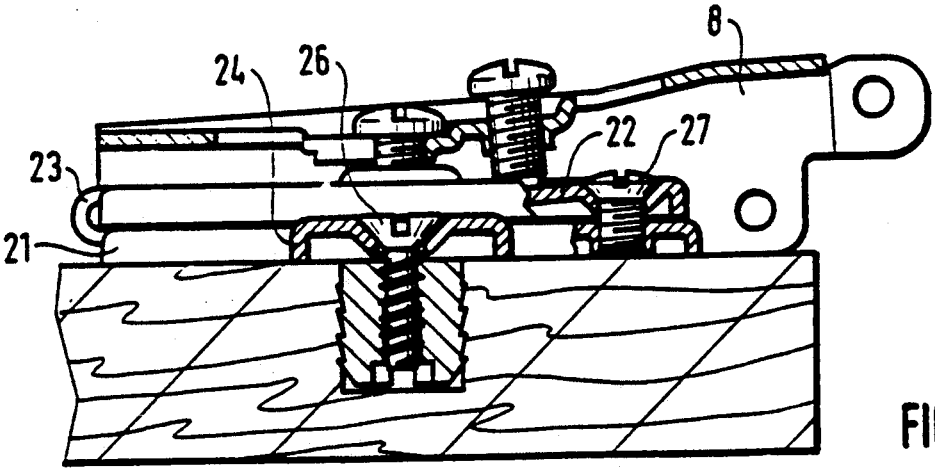
FIG. 4 shows, partly in longitudinal section, a mounting plate which is fixed by screws to a corpus part of a furniture piece and includes two plate elements, which have been bent to lie one on the other, and a hinge bracket connected to the upper plate element.

In the illustrative embodiment shown in FIG. 4, the mounting plate is formed from a sheet steel blank having a cover plate element 22, which has been reversely bent over on itself through 180 degrees to form, in addition to cover plate element 22, a base plate element 21. The cover and base plate elements are integrally connected at rear ends thereof by a bight 23. The base plate element 21 is provided with lateral wing portions 24, similar to wing portions 16 and 17 of FIG. 3, which have bores for receiving plug screws 26. The forward end portion of the cover plate element 22 is formed with a transverse slot, through which a clamp screw 27 extends. Clamp screw 27 is screwed into a flanged, tapped bore (not indicated) in the base plate element 21. Hinge bracket 8 is secured to the cover plate element 22 in the usual manner by a backing screw 12 and fixing or clamping screw 10. When the clamping screw 27 is loosened, the cover plate element 22 of the mounting plate can be pivotally moved about a pivotal axis defined by the bight 23 for an adjustment in height.

Figure 11:
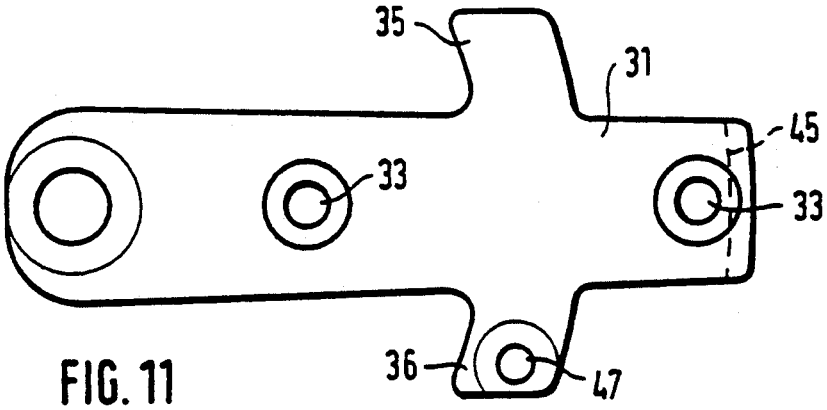
FIG. 11 is a top plan view showing the base plate element.

In the embodiment illustrated in FIGS. 5 to 11, the mounting plate, generally indicated by reference number 30, is bipartite and includes base plate element 31, which is adapted to be fixed by screws to the corpus part, which may be formed, for example, by a door frame, and a cover plate element 32, which covers the base plate element 31. Referring to FIG. 11, it can be seen that the base plate element 31 is provided with two bores 33, each of which has a beveled edge forming a countersunk portion to receive the heads of screws 34 so that the base plate element 31 can be fixed to the corpus part. The base plate element 31 is generally cross-shaped, due to arcuately curved base plate side portions 35 and 36, which laterally extend from the remainder, or central portion, of the base plate element 31. In its rear end portion, the base plate element and the cover plate element include aligned bores within which is carried a bushing 37. Bushing 37, more specifically, has reversely bent, longitudinally opposite rims, and extends through a first bore 38*a* in the cover plate element 32 and a second bore 38*b* in the base plate element 31 to pivotally connect the cover plate element 32 to the base plate element 31. The bushing 37 defines a pivotal axis, about which the cover plate element 32 is pivotally movable relative to the base plate element 31.

The cover plate element 32 is also provided with lateral wing portions 40 and 41, which conform to the base plate element 31 by overlapping and covering the wing portions 35, 36 of the base plate element 31. The cross-shaped cover plate element 32 includes a depending flange 43, which extends around the base plate element 31 on all sides, with a clearance which is sufficiently large so that the cover plate element 32 can be pivotally moved relative to the base plate element 31 through the required angle α.

The base plate element 31 is provided, at the forward edge of its central portion, with a circumferentially rounded edge portion 45, which rises from the surface of the corpus part and has an inwardly beveled edge face 46. As is apparent from FIG. 9, the forward edge portion 45 extends into a complementary V-shaped groove (not indicated) in the forward edge portion of the cover plate element 32 to interlock elements 31 and 32.

Referring to FIGS. 6–8, 10 and 11, it may be seen that the shank 48 of an eccentric 49 is secured by riveting, or in any other desired way, in a bore 47, and extends through a slot 50 in the wing portion 40 of the cover plate element 32 so that the head of the eccentric 49 is able to be received and lie in a recess 51 of the wing portion 40. The head of the eccentric 49 is provided with a slot 53 for receiving a screwdriver. The screwdriver can be used to rotate the eccentric 49 in bore 47 to pivotally move the cover plate element 32 relative to the base plate element 31 through the angle α. The hinge bracket 8 is secured to the central portion of the cover plate element 32 in the manner which has been explained in connection with the embodiment illustrated in FIGS. 1 and 2.

Figure 8:
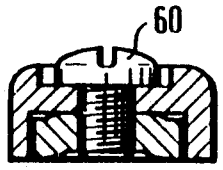
FIG. 8 is a sectional view which corresponds to FIG. 6 and shows a mounting plate having a cover plate element provided with a slot.
Figure 7:
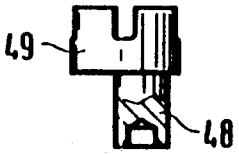
FIG. 7 is a side elevation view showing the adjusting eccentric.
Figure 6:
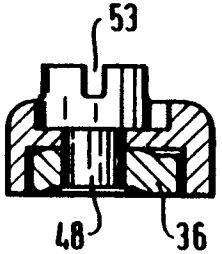
FIG. 6 shows the mounting plate of FIG. 5 in a sectional view as seen along line VI—VI thereof.
Figure 9:
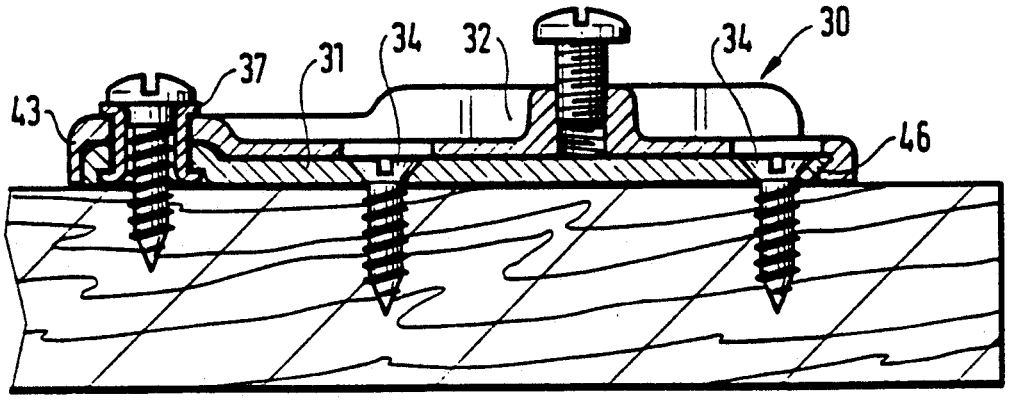
FIG. 9 is a longitudinal, sectional view showing the mounting plate of FIG. 5 without the hinge bracket.
Figure 10:
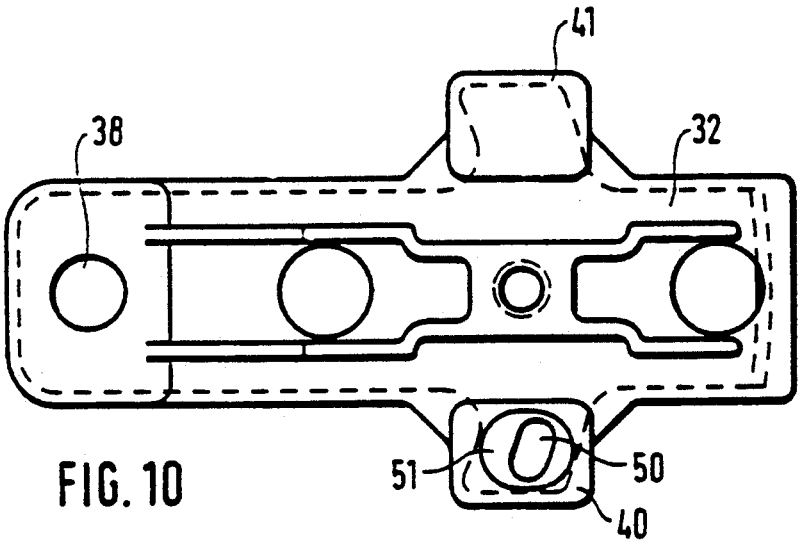
FIG. 10 is a top plan view showing the cover plate element.

In the embodiment illustrated in FIG. 8, the wing portion 36 of the base plate element 31 may be provided with a tapped bore, into which a fixing screw 60 has been screwed. In this case, pivotal movement and fixation of the cover plate element 32 relative to the base plate element 31 in angular positions which correspond to the desired adjustment are permitted by the provision of a transversely extending slot in the wing portion 40 of the cover plate 32. Such a slot is concentric with the bushing 37, or tangential to a corresponding arcuate line.

Figure 12:
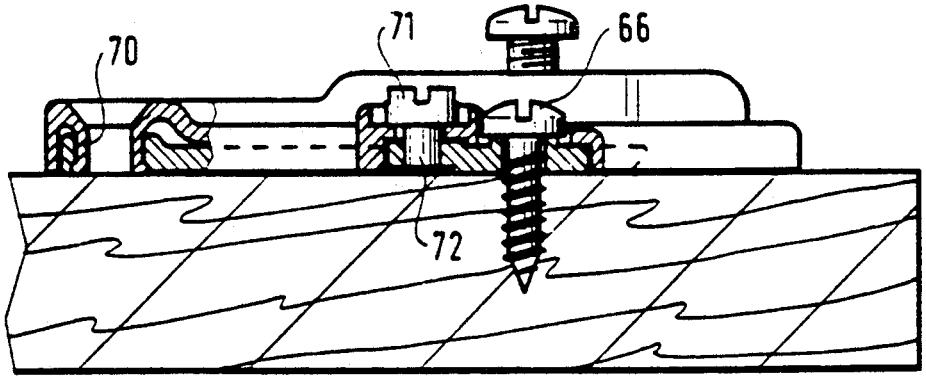
FIG. 12 shows a further embodiment of a cross-shaped mounting plate, including a base plate element and an overlying cover plate element.
Figure 13:
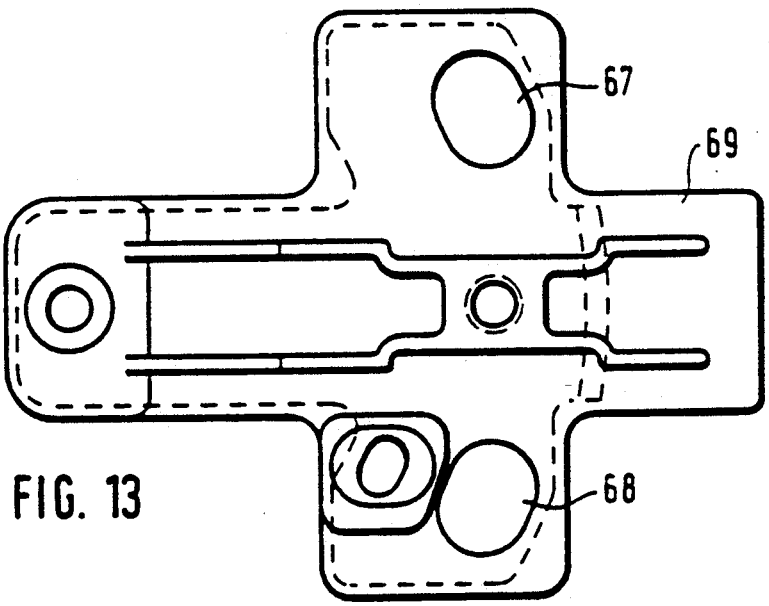
FIG. 13 is a top plan view showing the mounting plate of FIG. 12.
Figure 14:
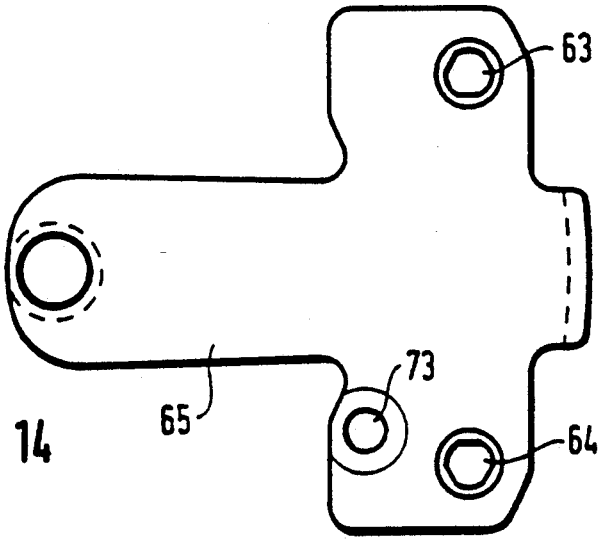
FIG. 14 is a top plan view showing the base plate element of FIG. 12 with the cover plate element removed.

In the embodiment shown in FIGS. 12 to 14, fixing bores 63 and 64 are provided in wing portions of the base plate element 65, and heads of the fixing screws 66 are accessible through sufficiently wide slots 67 and 68 formed in the wing portions of the cover plate element 69.

As is illustrated, a bushing portion 70, which defines the pivotal axis is integrally cast with the cover plate element 69. The cover plate element 69 is secured, but allowed to pivot relative to base plate elements 65 by means of an eccentric 71, which has a shank 72 that is eccentric to the head and is rotatably riveted or otherwise retained in bore 73 formed in a wing portion of the base plate element 65. As is clear from FIG. 12, the cover plate element 69 is pivotally connected to base plate element 65 by bushing portion 70.

Figure 15:
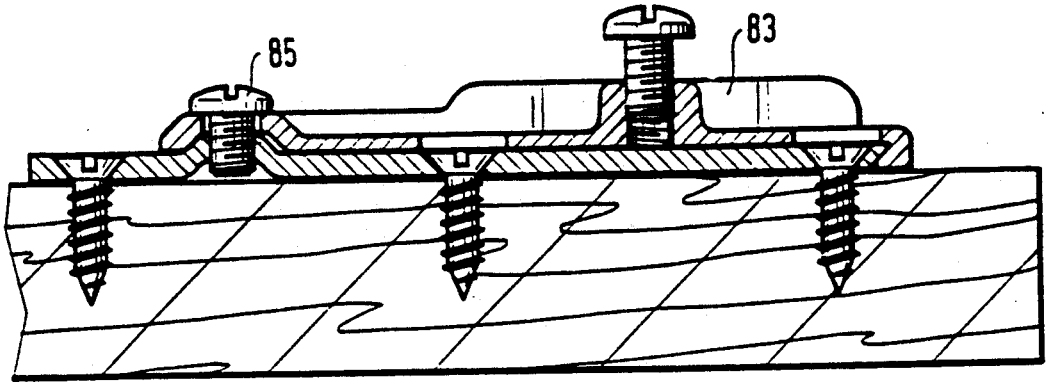
FIG. 15 is a longitudinal sectional view showing a further embodiment of a mounting plate including a base plate element and a cover plate element.
Figure 16:
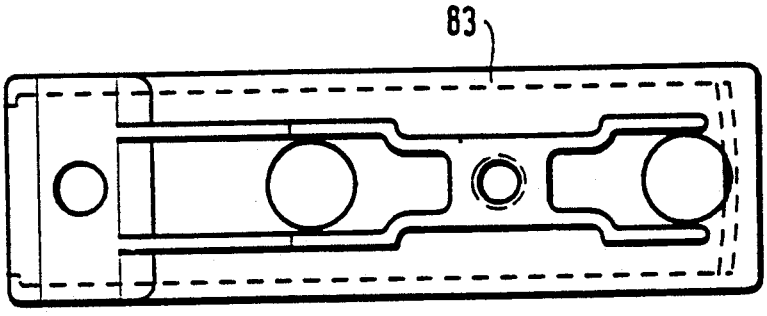
FIG. 16 is a top plan view showing the mounting plate of FIG. 15.
Figure 17:
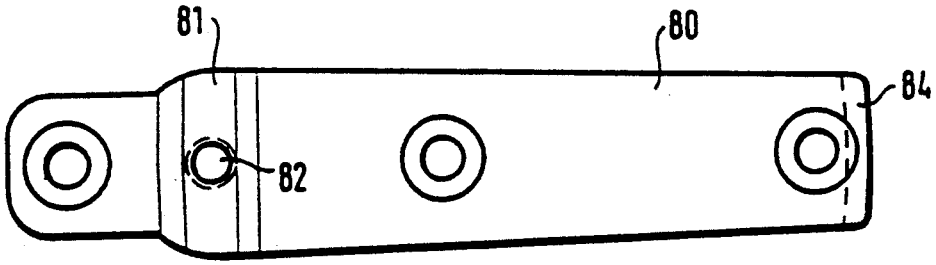
FIG. 17 is a top plan view showing the base plate element with the cover plate element removed.

In the embodiment shown in FIGS. 15 to 17, the base plate element 80 is provided with a transversely extending rib 81, which is trapezoidal in cross-section and, in its central web portion, is formed with a tapped bore 82. The cover plate element 83 has a V-shaped groove 83*g*, which is hooked over the forward edge portion 84 of the base plate element 80. The forward edge portion 84 is rounded, as seen from a top plan view, and is beveled in the manner described previously in connection with the embodiment shown in FIGS. 5–11. The cover plate element 83 is provided, in its rear end portion, with a rearward groove (not indicated), which is complementary to the rib 81. As a result, the side face of the groove 83*g* and forward edge portion 84 can bear on each other like wedges. However, when a clamp screw 85 has been loosened, there is a clearance C, as is apparent from FIG. 15, between the forward side face of the rearward groove and the associated forward edge of the rib 8, as well as a clearance between groove 83*g* and forward edge portion 84. The clamp screw 85 extends through the cover plate element 83 in a bore which opens to the bottom of the rearward groove. The screw 85 defines a pivotal axis, about which the cover plate element 83 can be pivotally moved relative to the base plate element 80 when the clamp screw 85 has been loosened. As soon as the pivotal movement through the required angle has been effected for an appropriate adjustment in height, the clamp screw 85 is tightened so that the outer side faces of the rib and groove slide on each other. The forward edge portion 84 of the base plate element 80 is simultaneously clamped in the complementary forward V-shaped groove 83*g* of the cover plate element 83 to secure the cover plate element 83 in position relative to base plate element 80.

The embodiments of the invention described in detail above are merely illustrative. The appended claims are intended to protect all equivalents of the specifically described embodiments.

I claim:

1. A device for mounting a hinge bracket, comprising:

a mounting plate for securing the hinge bracket to a corpus part, wherein said mounting plate is secured to the corpus part and comprises a slot comprising a bore in a forward portion of said mounting plate, means for adjustably securing a hinge bracket to said mounting plate and a pivotal axis in a rear portion of said mounting plate, said mounting plate being pivotally movable relative to the corpus part about said pivotal axis wherein said pivotal axis may be imaginary or defined by a pivot, said slot comprising means for guiding said mounting plate for limited pivotal movement about said pivotal axis, and retaining means within said bore for retaining said mounting plate in adjustable angular position relative to said corpus part, wherein said slot extends perpendicular to a connecting line between said pivotal axis and a central point of said slot.

2. A device according to claim 1, wherein said pivotal axis is defined by a first fixing screw, which is adapted to be screwed into the corpus part, and the retaining means comprises a second fixing screw, which extends through said slot.

3. A device according to claim 2, wherein the bore for the first fixing screw is provided on a longitudinal center line of the mounting plate and the slot is transverse to said longitudinal center line.

4. A device according to claim 2, wherein the mounting plate is cross-shaped and is provided, in, its rear end portion or in a wing portion defining the rear end portion, with a bore for the first fixing screw, and the mounting plate is provided, in another lateral wing portion defining the forward end portion, with a slot.

5. A device according to claim 1, wherein the mounting plate includes two parallel sheet steel plate elements, forming a base plate element and a cover plate element, which lie one on the other and are integrally connected at rear portions thereof by a curved bight, the base plate element being provided with fixing bores, the cover plate element being formed, in its forward portion, with the slot, and wherein said retaining means comprises a fixing screw extending through said slot and is screwed into a tapped bore formed in the base plate element.

6. A device according to claim 5, wherein the base plate element is provided with lateral wing portions formed with bores for receiving fixing screws.

7. A device according to claim 1, wherein the mounting plate includes a base plate element, which is adapted to be fixed by screws to the corpus part, and a cover plate element, which, at least partly, covers said base plate element and is pivoted on a pivotal axis provided in a rear portion of the base plate element, a forward portion of the base plate element being provided with a guide or a guide portion for guiding the cover plate element.

8. A device according to claim 7, wherein the pivotal axis is defined by a bushing.

9. A device according to claim 7, wherein the guide or guide portion includes a forward edge portion of the base plate element, which edge portion is concentrically curved about the pivotal axis and extends into an approximately mating groove of the cover plate element.

10. A device according to claim 9, wherein the forward edge portion of the base plate element has a side face extending at an acute angle with the top surface of the base plate element.

11. A device according to claim 1, wherein an eccentric is provided for effecting the pivotal movement.

12. A device according to claim 7, wherein the base plate element is provided with lateral wings, and an eccentric for effecting the pivotal movement is arranged in a portion of at least one of said lateral wings, said eccentric being provided on the cover plate element and overlying a wing of the base plate element.

* * * * *